US008322358B2

(12) United States Patent
Kipp

(10) Patent No.: US 8,322,358 B2
(45) Date of Patent: Dec. 4, 2012

(54) PLUG PULLER FOR DRAIN CLEAN-OUT AND METHOD OF USING

(76) Inventor: Brian Michael Kipp, Valparaiso, IN (US)

( * ) Notice: Subject to any disclaimer, the term of this patent is extended or adjusted under 35 U.S.C. 154(b) by 396 days.

(21) Appl. No.: 12/710,093

(22) Filed: Feb. 22, 2010

(65) Prior Publication Data

US 2010/0212075 A1 Aug. 26, 2010

Related U.S. Application Data

(60) Provisional application No. 61/154,065, filed on Feb. 20, 2009.

(51) Int. Cl.
*E03D 9/00* (2006.01)

(52) U.S. Cl. ..... 137/15.08; 137/15.18; 137/315.41; 4/255.01

(58) Field of Classification Search ..... 137/315.41, 137/315.42, 15.18, 15.08; 251/367; 81/121.1; 4/255.01
See application file for complete search history.

(56) References Cited

U.S. PATENT DOCUMENTS

| | | | | |
|---|---|---|---|---|
| 1,595,186 | A | | 2/1925 | Gray |
| 2,241,560 | A | | 9/1939 | Schouler |
| 2,451,051 | A | | 10/1948 | Tubbs |
| 2,602,168 | A | | 12/1949 | Lally et al. |
| 2,576,640 | A | * | 11/1951 | Ramsey ..... 4/255.01 |
| 4,159,721 | A | | 7/1979 | Horter |
| 4,413,654 | A | * | 11/1983 | Jahn ..... 138/92 |
| 4,546,789 | A | | 10/1985 | Taylor |
| 5,144,699 | A | | 9/1992 | Graham |
| D375,786 | S | | 11/1996 | Morris |
| 7,213,273 | B2 | * | 5/2007 | Wang ..... 4/255.01 |
| 2005/0283890 | A1 | | 12/2005 | Schaaf |
| 2006/0156467 | A1 | | 7/2006 | Mellon |
| 2008/0184783 | A1 | | 8/2008 | Chromey |

* cited by examiner

*Primary Examiner* — Kevin Lee
(74) *Attorney, Agent, or Firm* — Hartman Global IPLaw; Gary M. Hartman; Domenica N. S. Hartman

(57) ABSTRACT

A plug puller device and method for removing a clean-out plug from a drain clean-out and permit draining of a drain line below an obstruction prior to removing the obstruction. The device includes first and second housings. The first housing includes a drain connected to its interior. The first end of the first housing is adapted to be removably attached to the clean-out. The first end of the second housing is removably attached to the second end of the first housing. A rod is slidably received in an opening at the second end of the second housing. A fitting is attached to a first end of the rod for coupling and uncoupling with the plug through movement of the rod. A second end of the rod forms a connector to which a tool can be coupled to rotate the rod.

20 Claims, 4 Drawing Sheets

PLUG PULLER FOR DRAIN CLEAN-OUT AND METHOD OF USING

CROSS REFERENCE TO RELATED APPLICATIONS

This application claims the benefit of U.S. Provisional Application No. 61/154,065, filed Feb. 20, 2009, and is related to U.S. patent application Ser. No. 12/195,736 filed: Aug. 21, 2008, and U.S. Provisional Application Nos. 60/957,081 and 61/017,213, filed Dec. 28, 2007. The contents of these prior applications are incorporated herein by reference.

BACKGROUND OF THE INVENTION

The present invention generally relates to plumbing equipment, and more particularly to problems associated with cleaning a plugged sewage drain line, for example, of the types found in residential and commercial buildings.

If a sewage drain line becomes obstructed in a residential or commercial building, the blockage is typically removed with a clean-out tool, for example, a rod or cable inserted through a clean-out located in the drain line below the obstruction. The clean-out is often, though not necessarily, a branch of a Y-fitting whose other branch is inline with the drain line. A plug is typically installed in the clean-out and must be removed before inserting the clean-out tool. A common problem encountered with drain clean-outs is that as soon as the clean-out plug is removed, any sewage below the obstruction rapidly drains from the drain line as the clean-out plug is being removed, often resulting in a spill that must be cleaned.

U.S. Pat. No. 2,241,560 to Schouler, U.S. Pat. No. 4,159,721 to Horter, U.S. Pat. No. 5,144,699 to Graham, and U.S. Published Patent Application No. 2005/0283890 to Schaaf are each concerned with draining a drain system prior to attempting to remove an obstruction. Schouler discloses a valve between a drain system and a clean-out plug, and through which sewage can drain to a hose. Schaaf discloses a drain valve that, while located downstream of a drain plug, enables a drain system to be drained without removing the plug. Graham discloses a drain hose attached downstream of a valve that operates as a drain plug on a drain system. Horter discloses a drain hose attached downstream from a clean-out plug of a drain system. Horter provides a sleeve adapted to be secured to the end of a clean-out fitting in which the plug is installed, and removal of the plug is performed by inserting one's hand into a glove attached to the opposite end of the sleeve and then grasping and turning the plug with the user's gloved hand. The glove is then removed from the sleeve to permit the insertion of a clean-out tool through the sleeve and into the drain system.

U.S. Pat. No. 2,451,051 to Tubbs discloses a clean-out device and method for removing an obstruction from a drain line without the need to drain the line prior to removing the obstruction. Tubbs' device is intended for use above an obstruction, which results in the device being subject to much if not all of the hydraulic pressure exerted by the sewage above the obstruction. The device is shown attached to an upward-extending branch of a Y-fitting that is installed in a vertical sewer pipe and has a clean-out plug installed at its upper end. The clean-out device includes a cylinder having a lower end adapted to be attached to the upper end of the branch and an upper end with two openings, one of which permits a clean-out tool to be inserted into the cylinder. The device further includes a rod adapted to be attached to the plug with a cotter pin. The clean-out device is intended to be temporarily installed on the branch when required to remove an obstruction in the sewer pipe. In use, the rod is first attached to the plug and the cylinder is installed over the rod and attached to the upper end of the branch, after which the clean-out tool is inserted into the cylinder through the opening in the upper end of the cylinder. During installation of the cylinder onto the branch, the rod is passed through the second of the two openings at the upper end of the cylinder to enable the rod to be operated from outside the cylinder to remove the plug from the branch. Once the plug is removed from the branch and tilted out of the way, the clean-out tool is used to remove the obstruction within the sewer pipe. Thereafter, the sewer pipe can be flushed with water introduced through a faucet mounted to the side of the cylinder. Accordingly, the intent of Tubbs' clean-out device is to prevent any sewage from draining from the drain line prior to and during removal of an obstruction.

BRIEF DESCRIPTION OF THE INVENTION

The present invention provides a plug puller device and method for removing a clean-out plug from a drain clean-out and draining the contents of a drain line. In particular, the plug puller device and method are adapted to remove a clean-out plug from a drain line to permit draining of the drain line below an obstruction in the drain line prior to removal of the obstruction and draining sewage from the drain line above the obstruction.

According to a first aspect of the invention, the plug puller device includes first and second housings, each with oppositely-disposed first and second ends, an interior therebetween, and coaxial first and second openings defined in the first and second ends, respectively. The first housing further includes a drain disposed between its first and second ends and in fluidic communication with the interior of the first housing. The first end of the first housing is adapted to be removably attached to a clean-out of a drain line and form a fluid-tight seal therewith. The first end of the second housing is adapted to be removably attached to the second end of the first housing to form a fluid-tight seal therewith, coaxially align the first and second openings of the first and second housings, and fluidically connect the interiors of the first and second housings. The device further includes a rod slidably received in the second opening of the second housing. The rod has a first end adapted to be disposed within the interiors of the first and second housings and a second end disposed outside the second housing. The rod is of sufficient length relative to the first and second housings so that the first end thereof can be positioned adjacent the first end of the first housing while the second end of the rod is disposed outside the second housing. The device also includes means for closing the second opening of the second housing with the rod and form a fluidic seal therebetween, a first connector at the first end of the rod, a second connector at the second end of the rod and adapted for coupling to a tool and enable the tool to rotate the rod about a longitudinal axis thereof, and a fitting adapted to be connected to the first end of the rod with the first connector. The fitting is adapted to selectively couple and uncouple with a clean-out plug installed in the clean-out of the drain line after the clean-out plug puller device has been attached thereto. Coupling and uncoupling between the fitting and the clean-out plug can be achieved simply by moving the rod in a longitudinal direction of the rod coinciding with axes of the fitting and the clean-out plug.

According to a second aspect of the invention, the method generally entails providing a clean-out plug puller device comprising a first housing having a first end adapted to secure the clean-out plug puller device to the clean-out, a second housing attached to the first housing and adapted to close an opening at a second end of the first housing, and a rod that passes through an opening in the second housing such that a first end of the rod is within the clean-out plug puller device and a second end of the rod is outside the clean-out plug puller device. The clean-out plug puller device is secured to the clean-out by securing the first end of the first housing to the clean-out so that the clean-out plug of the clean-out is disposed within an interior of the first housing. The clean-out plug is then engaged with a fitting removably coupled to the first end of the rod, and the clean-out plug is removed from the clean-out by rotating the rod with a tool coupled with the second end of the rod. As a result of removing the clean-out plug, sewage from below the obstruction within the drain line is drained from the drain line through a passage defined by and within the clean-out, the first housing, and a drain of the first housing. The second housing and rod are then removed from the first housing, exposing the second opening of the housing through which a clean-out tool is passed through the first housing and through the clean-out to remove the obstruction from the drain line.

In view of the above, the plug puller device and method enable a clean-out plug to be removed from a clean-out of a drain line and the drain line drained downstream of (below) an obstruction without risk of sewage spilling out as the plug is being removed. Following removal of the plug and sewage below the obstruction, a cable, rod or other suitable clean-out tool can be inserted into the drain line through the device and clean-out. Sewage above the obstruction can be drained in a similar manner to the sewage below the obstruction.

Other objects and advantages of this invention will be better appreciated from the following drawing descriptions.

DETAILED DESCRIPTION OF THE INVENTION

Figure 1:
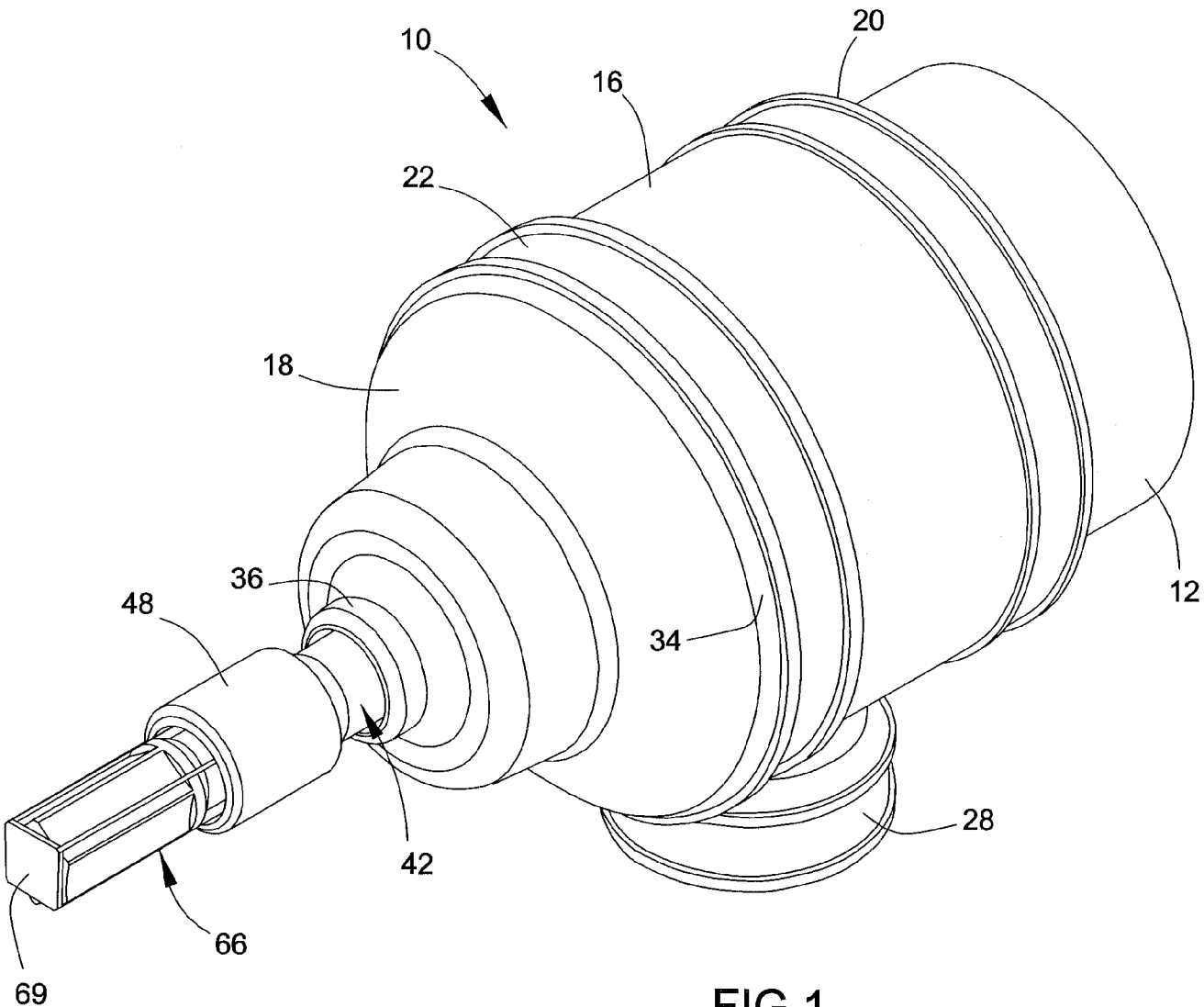
FIGS. 1 and 2 are perspective and side views, respectively, of a plug puller device in accordance with an embodiment of the invention.
Figure 2:
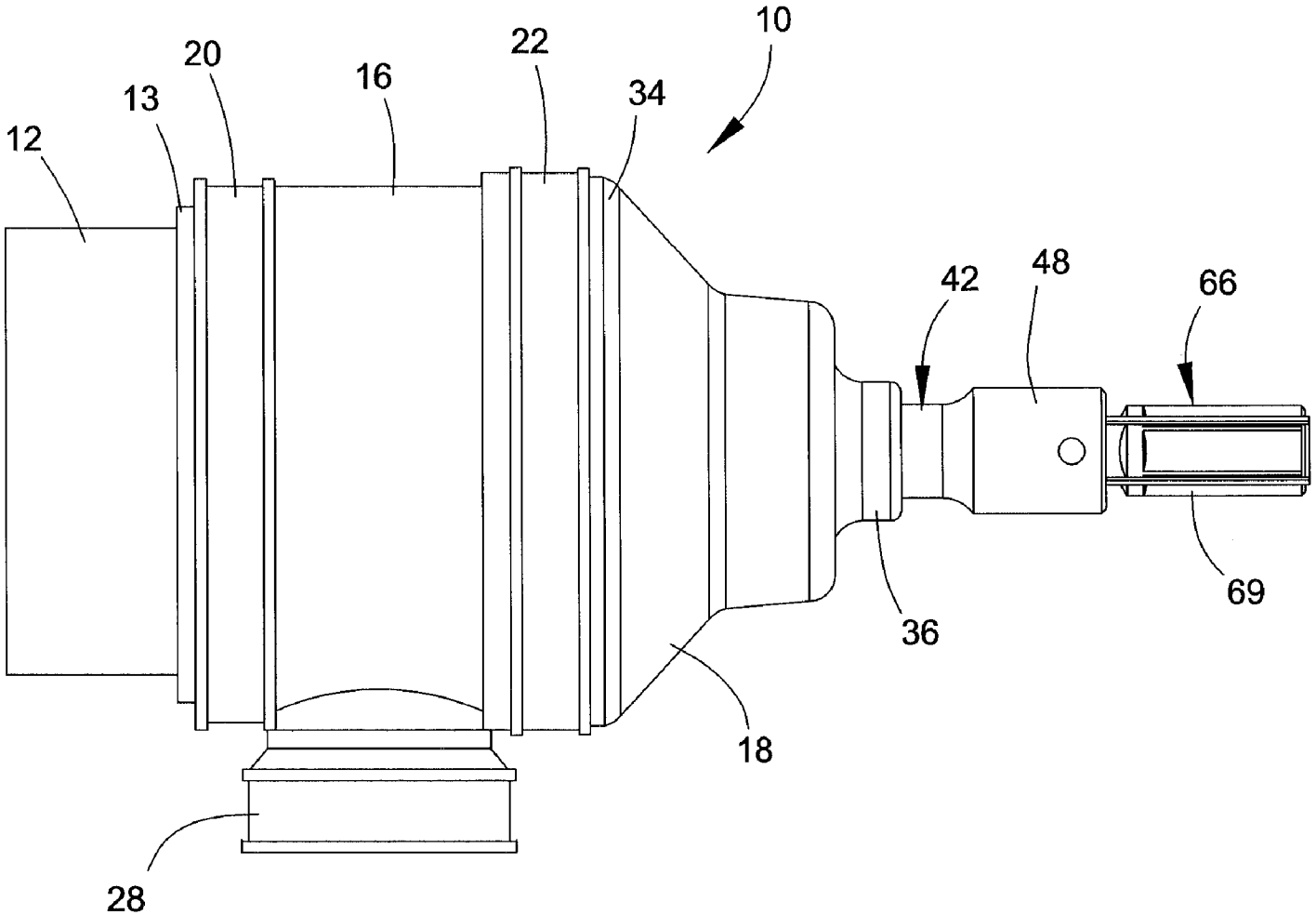
Figure 3:
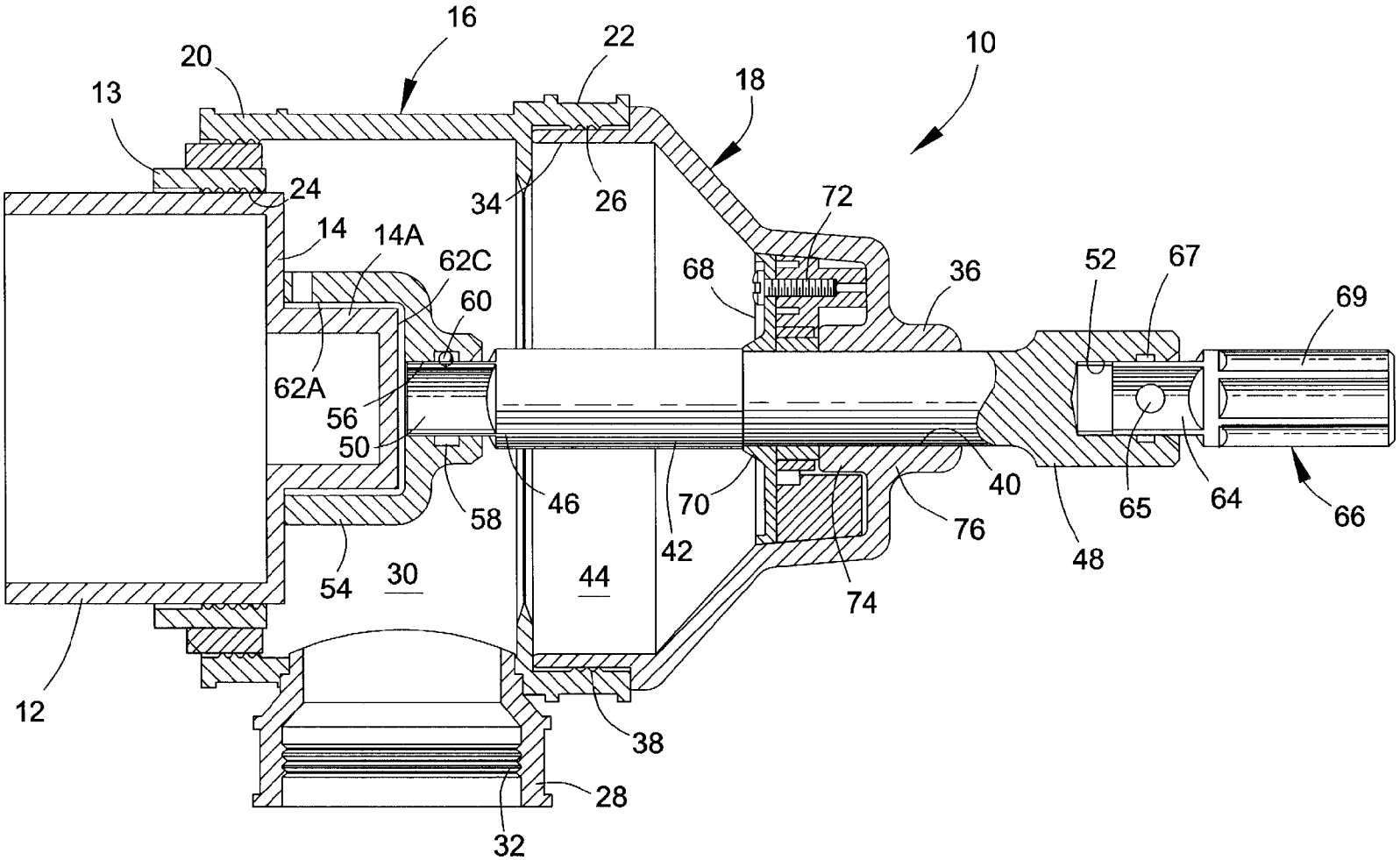
FIG. 3 is a cross-sectional view of the plug puller device of FIGS. 1 and 2 mounted to a clean-out of a drain line.

FIGS. 1 through 3 represent a clean-out plug puller device 10 in accordance with an embodiment of this invention. The device 10 is particularly well suited for installation on clean-outs of drain lines found in, as examples, residential and commercial buildings, and which receive sewage from one or more drain pipes above the drain line. The drawings are drawn for purposes of clarity when viewed in combination with the following description, and therefore are not necessarily to scale.

FIG. 2 shows the device 10 mounted on a clean-out 12 of a sewage/drain line (not shown) from which an obstruction is to be removed. In a conventional plumbing system, the clean-out 12 is often a branch of a Y-fitting whose other branch is inline with the drain line. A clean-out plug 14 (FIG. 3) is installed in an opening of the clean-out 12, typically with complementary male and female threads (not shown). The device 10 is adapted to be removably mounted to the clean-out 12, remove the clean-out plug 14, and drain sewage within the clean-out 12 and drain line below an obstruction in the drain line before attempting to place a rod, cable or other clean-out tool through the clean-out 12 to remove the obstruction above the clean-out 12.

In FIGS. 1 through 3, the device 10 is represented as comprising a pair of housings 16 and 18, one of which will be referred to as a boot 16 and the other a tool guide 18. Various materials, including conventional plumbing-grade materials such as polyvinylchloride (PVC), can be used to form the boot 16 and tool guide 18. While the two-piece housing assembly represented in FIGS. 1 through 3 is preferred to minimize the complexity of the device 10, it is foreseeable that additional housing members could be employed to define the exterior housing structure of the device 10.

The boot 16 generally has a cylindrical shape that defines oppositely-disposed axial ends 20 and 22, one of which is a mounting end 20 adapted to secure the device 10 to the clean-out 12, while the other will be referred to as a clean-out end 22. The mounting end 20 of the boot 16 is shown in FIG. 3 as equipped with female threads 24 that permit mounting the device 10 on the clean-out 12, such as by threading the boot 16 onto a male-threaded sleeve 13 secured to the outer perimeter of the clean-out 12 as represented in FIG. 3. Alternatively, an adhesive, clamp, expansion seal, or other permanent or temporary mounting technique could be used to secure the device 10 to the clean-out 12. The connection between the boot 16 and clean-out 12 is preferably fluid-tight. The clean-out end 22 of the boot 16 is also shown as equipped with female threads 26 for temporarily mounting the tool guide 18 to the boot 16. The ends 20 and 22 of the boot 16 define openings that are represented in FIGS. 1 through 3 as roughly the same size and substantially coaxial. At a lower side of its circumference, the boot 16 is equipped with a drain 28 fluidically connected to the interior 30 of the boot 16. The axis of the drain 28 is oriented generally as a radial to the axis of the boot 16. The drain 28 is shown in FIG. 3 as having female threads by which a hose or other suitable conduit can be connected to the device 10.

The tool guide 18 generally has a funnel or tapered shape that defines oppositely-disposed axial ends 34 and 36. An opening at the larger end 34 is equipped with male threads 38 that mate with the female threads 26 at the clean-out end 22 of the boot 16 to secure the tool guide 18 to the boot 16. Alternatively, it is foreseeable that the tool guide 18 could be secured to the boot 16 by other means, such as a clamp, expansion seal, or other temporary mounting technique. As with the connection between the boot 16 and the clean-out 12, the connection between the boot 16 and tool guide 18 is preferably fluid-tight. The smaller end 36 of the tool guide 18 contains a bore 40 in which a rod 42 is slidably received, such that the longitudinal axis of the rod 42 coincides with the axes of the openings at the ends 20, 22 34 and 36 of the boot 16 and tool guide 18. The bore 40 is coaxial with, but significantly smaller than, the opening at the larger end 34 of the tool guide 18. It is foreseeable that the bore 40 could be larger than that shown, including as large as the opening at the end 34. However, the relative diameter and length of the bore 40 shown in FIG. 3 are advantageous for providing stability to the rod 42, maintaining the rod 42 coaxial with the openings in the ends 20, 22 and 34 of the boot 16 and tool guide 18 and centrally disposed within the interiors 30 and 44 of the boot 16 and tool guide 18, and maintaining a fluid-tight seal between the tool guide 18 and the rod 42. The tapered shape of the tool guide 18 results in an interior 44 being defined within the tool guide 18, of which the portion adjacent the end 34 of the tool guide 18 is substantially cylindrical and the portion adjacent the bore 40 has a frustoconical shape. It is foreseeable and within the scope of the invention that the taper of the tool guide 18 could be significantly increased to the extent that the interior 44 is much smaller than shown and even substantially eliminated, such that the tool guide 18 is similar in shape to a disk-shaped plug that closes the opening of the boot 16 at its clean-out end 22.

FIG. 3 represents the tool guide 18 as being equipped with a wiper 68 secured by screws 72 within the interior 44 adjacent the bore 40. The wiper 68 comprises an annular-shaped wiper seal 70 that defines a seal opening in which the rod 42 is received. The wiper seal 70 surrounds and contacts the perimeter of the rod 42 and serves to wipe the rod 42 as it is being withdrawn from the tool guide 18. The wiper 68 is represented as abutting an internal boss 74 within the tool guide 18 that, in combination with an external boss 76 at the second end 36 of the tool guide 18, defines the bore 40 in which the rod 42 is received. The additional length of the bore 40 provided by the bosses 74 and 76 serves to promote the stability of the rod 42, sealing of the rod 42 with the wiper 68, and effectively prevent the rod 42 from being deflected out of coaxial alignment with the axes of the openings of the boot 16 and tool guide 18. In the embodiment represented in FIG. 3, the entire rod 42 can be completely withdrawn from the tool guide 18 through the wiper 68 and bore 40.

Figure 4:
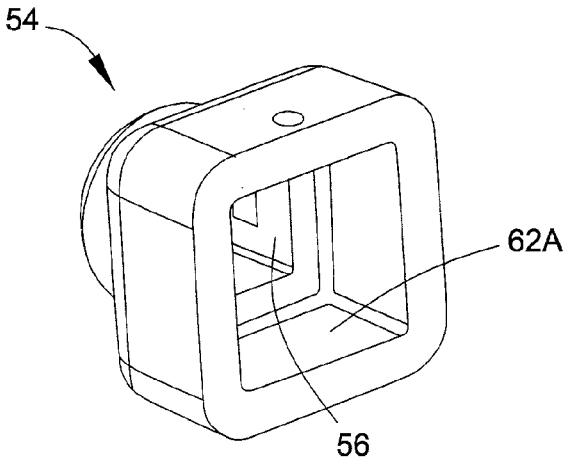
FIGS. 4, 5, 6, 7 and 8 are perspective views of fittings that can be used with the device of FIGS. 1 through 3.

The rod 42 is represented in FIG. 3 as having connectors 50 and 52 defined at its longitudinally-opposite ends 46 and 48. The connector 50 is represented as a shaft that permits a fitting 54 to be secured to the end 46 of the rod 42. The fitting 54 is equipped with a drive socket 56 of a size and shape complementary to the connector 50, such that the fitting 54 can be retained on but removed from the rod 42. As a nonlimiting example, the connector 50 and socket 56 can have complementary square cross-sections, such as of the type commonly found on ratchet wrenches. Retention of the fitting 54 can be promoted by providing the socket 56 with an annular groove 58 that cooperates with a spring-loaded ball detent mechanism 60 on the connector 50, again similar to that found on ratchet wrenches and their sockets. The fitting 54 is further shown in FIG. 3 as defining a drive socket 62A of a size and shape complementary to a boss 14A on the clean-out plug 14. As a nonlimiting example, clean-out plug bosses often have square cross-sectional shapes. For use with square-shaped plug bosses, the socket 62A is represented in FIG. 4 as also having a square-shaped cross-section.

Figure 5:
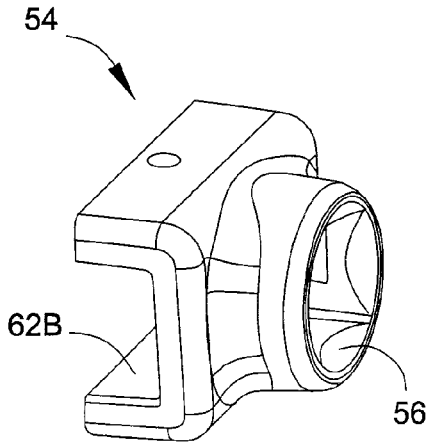
Figure 7:
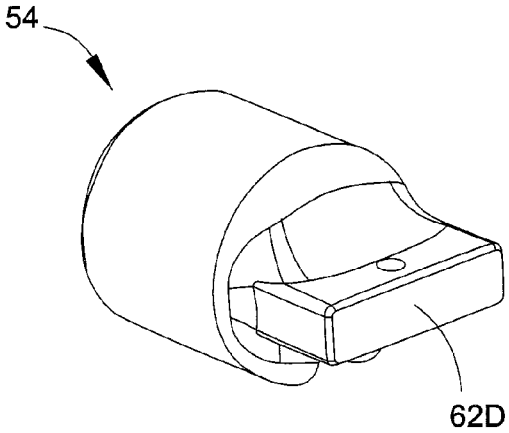
Figure 6:
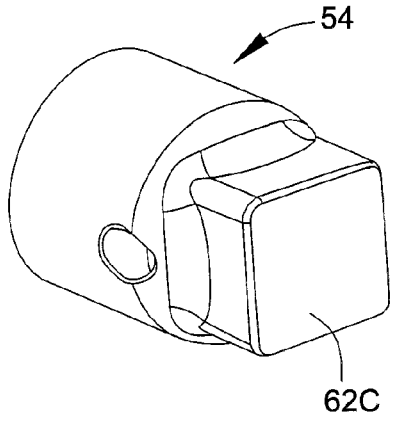

FIGS. 5 through 8 represent additional but nonlimiting configurations for the fitting 54. In FIG. 5, the fitting 54 has a drive socket 62B whose size and shape enable the fitting 54 to couple with a rectangular-shaped plug boss. FIGS. 6 and 7 show embodiments of the fitting 54 in which drive shafts 62C and 62D are provided in place of the sockets 62A and 62B. The drive shaft 62C of FIG. 6 is configured to have a cross-sectional size and shape for coupling to a square-shaped recess or socket formed in a clean-out plug, whereas the shaft 62D of FIG. 7 is configured to have a cross-sectional size and shape for coupling to a rectangular-shaped recess or socket in a clean-out plug. The sockets 62A and 62B of FIGS. 4 and 5 and the shafts 62C and 62D of FIGS. 6 and 7 may optionally be equipped with retention features, such serrations or teeth (not shown), that assist in retaining the fitting 54 on the boss 14A.

Figure 8:
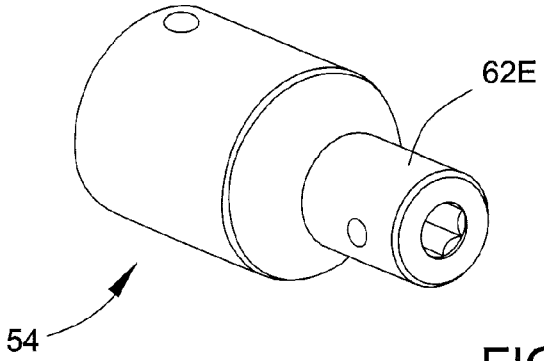

The fitting 54 represented in FIG. 8 is represented as comprising a chuck 62E with which a hex key or drive or a drill bit can be secured. For example, a hex drive may be necessary if the clean-out plug 14 has a hex-shaped socket, or a drill bit may be useful to allow draining of the clean-out 12 through a hole drilled through the plug 14 if the plug 14 is seized within the clean-out 12 and cannot be removed with the device 10.

The connector 52 at the end 48 of the rod 42 opposite the fitting 54 is represented as a drive socket, similar to the drive socket 56 of the fitting 54. The connector 52 permits the insertion of a shaft 64 of an adapter 66 or tool having a complementary size and shape to the connector 52, such that the shaft 64 can be retained in yet uncoupled from the rod 42. As a nonlimiting example, the connector 52 and shaft 64 can have complementary square cross-sections, similar to sockets and shafts of ratchet wrenches as previously noted. Retention of the shaft 64 within the connector 52 can be promoted by configured the socket of the connector 52 to have an annular groove 67 that cooperates with a spring-loaded ball detent mechanism 65 on the shaft 64, again also previously described for the connection between the connector 50 and fitting 54 at the opposite end 46 of the rod 42. FIGS. 1 through 3 represent the end 69 of the adapter 66 opposite the shaft 64 as configured for coupling with a socket of a ratchet wrench. Alternatively, the adapter end 69 could be configured to enable engagement by an adjustable wrench, such as by having a square or rectangular cross-section. Another alternative is to configure the adapter end 69 for coupling with a power tool.

As evident from the above, the complementary shapes of the socket 56 and connector 50 and the complementary shapes of the sockets 62A-D and plug boss 14A enable the clean-out plug 14 to be threadably removed from the clean-out 14 by rotating the rod 42. Because a significant amount of torque may be necessary to remove the plug 14, the diameter of the rod 42 and the material from which the rod 42 is formed are preferably selected to ensure that the necessary torque can be delivered via the rod 42 without plastically deforming the rod 42. Similarly, the fitting 54 is also preferably formed of a material with sufficient strength to withstand the forces to which it is subjected when engaged with the boss 14 while being turned by the rod 42. Various materials are capable of meeting these requirements, including metal and engineering plastics well known to those skilled in the art. Because of the types of connections that can be used between the connectors 50 and 52 of the rod 42 and their respective socket 56 and shaft 64, it is foreseeable that an extension of a ratchet wrench could be used as the rod 42.

In use, the device 10 represented in FIGS. 1 through 3 and its fittings 54 represented in FIGS. 4 through 8 enable sewage below an obstruction in a drain line to be removed prior to removing the obstruction and releasing the sewage above the obstruction, and the released sewage safely drained through a clean-out with a hose or other conduit. The appropriate fitting 54 for the clean-out plug 14 is first coupled to the connector 50 of the rod 42, after which the device 10 is secured to the clean-out 12 by securing the mounting end 20 of the boot 16 to the clean-out 12 (such as with the sleeve 13) so that the clean-out plug 14 is disposed adjacent the mounting end 20 of the boot 16 and preferably within the interior 39 of the boot 16. The rod 42 is then pushed in its longitudinal direction toward the plug 14 to engage the plug 14 with the fitting 54. The plug 14 can then be removed from the clean-out 12 by rotating the rod 42 with the adapter 66 or a tool engaged with the connector 52 at the second end 48 of the rod 42, and then withdrawing the rod 42 through the interior 30 of the boot 16 so that the plug 14 is not an obstruction between the clean-out 12 and the drain 20 of the boot 16. For this reason, the shape of the tool guide 18 is advantageous because the frustoconical portion of the tool guide interior 44 is able to accommodate at least part of the fitting 54, and the cylindrical-shaped portion of the tool guide interior 44 can be sized to accommodate any remaining portion of the fitting 54 and typically at least part of the plug 14. Sewage below the obstruction within the drain line can then be drained through an unobstructed passage defined by and within the clean-out 12, the boot 16, the drain 28 and any hose or other conduit that might be attached to the drain 28. Spillage of the sewage is prevented since the tool guide 18 forms a fluid-tight seal with the boot 16 and rod 42, with the result that the only existing outlet of the device 10 is via the drain 28.

Once the sewage below the obstruction has been drained through the boot 16, the device 10 can be removed from the clean-out 12 to permit a rod, cable or other clean-out tool to be inserted into the clean-out 12 to remove the obstruction. In a preferred embodiment, only the tool guide 18 and rod 42 need be removed as an assembly from the boot 16 to expose the opening at the clean-out end 22 of the boot 16 and permit the insertion of the clean-out tool through the clean-out end 22 of to remove the obstruction. As such, the boot 16 can remain on the clean-out 12, enabling continued use of the drain 28 (and any conduit attached thereto) to remove sewage from the drain line above the obstruction as the obstruction is displaced and removed by the clean-out tool.

While the invention has been described in terms of specific embodiments, it is apparent that other forms could be adopted by one skilled in the art. For example, the invention could be employed on clean-outs, drain lines and stacks of essentially any diameter, the functions of each component of the device 10 could be performed by components of different construction but capable of a similar (though not necessarily equivalent) function, and appropriate materials could be substituted for those noted. Accordingly, it should be understood that the invention is not limited to the specific embodiments illustrated in the Figures. Therefore, the scope of the invention is to be limited only by the following claims.

The invention claimed is:

1. A clean-out plug puller device adapted to remove a clean-out plug from a drain line to permit draining of the drain line below an obstruction in the drain line prior to removal of the obstruction, the device comprising:

a first housing having oppositely-disposed first and second ends, an interior therebetween, coaxial first and second openings defined in the first and second ends, respectively, and a drain disposed between the first and second ends and in fluidic communication with the interior of the first housing, the first end being adapted to be removably attached to a clean-out of a drain line and form a fluid-tight seal therewith;

a second housing having oppositely-disposed first and second ends, an interior therebetween, and coaxial first and second openings defined in the first and second ends thereof, respectively, the first end of the second housing being adapted to be removably attached to the second end of the first housing to form a fluid-tight seal therewith, coaxially align the first and second openings of the first and second housings, and fluidically connect the interiors of the first and second housings;

a rod slidably received in the second opening of the second housing, the rod having a first end adapted to be disposed within the interiors of the first and second housings and a second end adapted to be disposed outside the second housing, the rod having a sufficient length relative to the first and second housings so that the first end thereof can be positioned adjacent the first end of the first housing while the second end of the rod is disposed outside the second housing;

means for closing the second opening of the second housing with the rod and form a fluidic seal therebetween;

a first connector at the first end of the rod;

a second connector at the second end of the rod and adapted for coupling to a tool and enable the tool to rotate the rod about a longitudinal axis thereof; and a fitting removably connected to the first end of the rod with the first connector, the fitting being adapted to selectively couple and uncouple with a clean-out plug installed in the clean-out of the drain line after the clean-out plug puller device has been attached thereto, wherein coupling and uncoupling between the fitting and the clean-out plug is achieved by moving the rod in a longitudinal direction of the rod coinciding with axes of the fitting and the clean-out plug.

2. The clean-out plug puller device according to claim 1, wherein the closing means comprises a wiper removably secured within the second housing adjacent the second end of the second housing, the wiper defining an opening having an axis that coincides with the axes of the first and second openings of the first and second housings, the wiper engaging a periphery of the rod to form the fluidic seal therewith.

3. The clean-out plug puller device according to claim 1, wherein the first end of the first housing has female threads for removably attaching the first housing to the clean-out and form the fluid-tight seal therewith.

4. The clean-out plug puller device according to claim 1, wherein the second end of the first housing and the first end of the second housing have mutually engageable threads for removably attaching the second housing to the first housing and form the fluid-tight seal therewith.

5. The clean-out plug puller device according to claim 1, wherein the first connector of the rod comprises a socket.

6. The clean-out plug puller device according to claim 5, further comprising an adapter having a first end engageable with the socket of the rod and an oppositely-disposed second end engageable with the tool so as to enable the tool to rotate the rod through the adapter.

7. The clean-out plug puller device according to claim 6, wherein the second end of the adapter comprises a shaft adapted for coupling with a socket or jaws of a wrench.

8. The clean-out plug puller device according to claim 1, wherein the first connector of the rod comprises a shaft and the fitting comprises a socket adapted for coupling with the shaft.

9. The clean-out plug puller device according to claim 8, wherein the shaft of the first connector comprises a spring-loaded ball detent mechanism for retaining the fitting on the rod.

10. The clean-out plug puller device according to claim 1, wherein the fitting comprises a socket adapted for coupling with a boss on the clean-out plug.

11. The clean-out plug puller device according to claim 1, wherein the fitting comprises a shaft adapted for coupling with a socket on the clean-out plug.

12. The clean-out plug puller device according to claim 1, further comprising a second fitting adapted to be connected to the first end of the rod with the first connector, the second fitting comprising a drill bit socket adapted to selectively couple and uncouple with drill bit.

13. The clean-out plug puller device according to claim 1, wherein the second opening of the second housing is smaller in cross-section than the first opening of the second housing.

14. A method of removing a clean-out plug from a clean-out of a drain line to permit draining of the drain line below an obstruction in the drain line prior to removal of the obstruction, the method comprising:

providing a clean-out plug puller device comprising a first housing having a first end adapted to secure the clean-out plug puller device to the clean-out, a second housing attached to the first housing and adapted to close an opening at a second end of the first housing, and a rod that passes through an opening in the second housing such that a first end of the rod is within the clean-out plug puller device and a second end of the rod is outside the clean-out plug puller device;

securing the clean-out plug puller device to the clean-out by securing the first end of the first housing to the clean-out so that the clean-out plug of the clean-out is disposed within an interior of the first housing;

engaging the clean-out plug with a fitting removably coupled to the first end of the rod;

removing the clean-out plug from the clean-out by rotating the rod with a tool coupled with the second end of the rod;

draining sewage below the obstruction within the drain line through a passage defined by and within the clean-out, the first housing, and a drain of the first housing;

removing the second housing and the rod from the first housing to expose the second opening of the first housing; and passing a clean-out tool through the second opening of the first housing, through the first housing, and through the clean-out to remove the obstruction from the drain line.

15. The method according to claim 14, wherein the first housing is secured to the clean-out with threads at the first end of the first housing that form a fluid-tight seal with the clean-out.

16. The method according to claim 14, wherein the second housing is secured to the first housing with threads that form a fluid-tight seal with the first housing.

17. The method according to claim 14, further comprising installing an adapter in a socket at the second end of the rod prior to the step of removing the clean-out plug from the clean-out, and then rotating the clean-out plug by rotating the rod with the tool coupled to the second end of the rod by the adapter.

18. The method according to claim 14, wherein the clean-out plug comprises a boss and the engaging step comprises coupling the boss on the clean-out plug with a socket on the fitting.

19. The method according to claim 14, wherein the clean-out plug comprises a socket and the engaging step comprises coupling the socket of the clean-out plug with a shaft on the fitting.

20. The method according to claim 14, wherein after the passing step the method further comprises draining sewage above the obstruction within the drain line through the passage defined by and within the clean-out, the first housing, and the drain.

* * * * *